United States Patent [19]

Gostyla

[11] Patent Number: 4,796,001

[45] Date of Patent: Jan. 3, 1989

[54] REPLACEMENT BALLAST STRUCTURES IN ROADWAY AND/OR AREA LUMINAIRES

[75] Inventor: Eugene J. Gostyla, Parsippany, N.J.

[73] Assignee: North American Philips Corp., New York, N.Y.

[21] Appl. No.: 57,725

[22] Filed: Jun. 2, 1987

Related U.S. Application Data

[63] Continuation of Ser. No. 819,432, Jan. 16, 1986, abandoned.

[51] Int. Cl.[4] ..... H01C 7/10; F21P 1/02

[52] U.S. Cl. ..... 338/20; 362/362; 362/374

[58] Field of Search ..... 338/20, 21; 362/362, 362/267, 375, 374

[56] References Cited

U.S. PATENT DOCUMENTS

| | | | |
|---|---|---|---|
| 3,654,453 | 4/1972 | Jablonski | 362/374 X |
| 4,019,044 | 4/1977 | Kelly et al. | 362/362 X |
| 4,516,196 | 5/1985 | Blake | 362/267 X |
| 4,538,217 | 8/1985 | Ewing et al. | 362/362 X |
| 4,551,792 | 11/1985 | Hoke et al. | 362/362 |

*Primary Examiner*—E. A. Goldberg
*Assistant Examiner*—M. M. Lateef
*Attorney, Agent, or Firm*—Paul R. Miller

[57] ABSTRACT

A low pressure sodium roadway and/or area luminaire is provided. In this structure, the ballast is present in a removable pod which can be removed and replaced solely by hand.

5 Claims, 5 Drawing Sheets

REPLACEMENT BALLAST STRUCTURES IN ROADWAY AND/OR AREA LUMINAIRES

This is a continuation of application Ser. No. 819,432, filed Jan. 16, 1986, now abandoned.

The present invention is directed to an improved roadway and/or area luminaire in which the ballast can be replaced in the field without the use of tools and with the use of gloves in cold weather. In particular, the present invention involves the structure of a removable ballast pod which can be removed from a luminaire and replaced with another pod.

Among various problems in roadway and/or area luminaire systems, particularly of the low pressure sodium type luminaires, the present invention provides significant improvements. Namely, the problems occurring by servicing roadway or area luminaires is significantly improved by the ability to remove the ballast compartment or pod and replace it by another. This removal and replacement can take place simply by hand without the use of tools in five easy steps.

This ability to remove and replace the ballast pod significantly improves the construction and use of low pressure sodium roadway and/or area light illuminaires. In addition, such low pressure sodium luminaires can be further improved by the use of a housing of a laminated plastic with the inside plastic serving as the light refractor and the outside layer serving as a protection from weather and exposure, including rain, ultraviolet radiation, and etc. Also, the housing can be constructed with an integral form structural beam for longitudinal strength. An adjustable socket support bracket and lamp support bracket allow the lamp to be moved into three separate positions to provide three separate photometric patterns in one fixture. Finally, a unique molded arm diaphragm seal which snaps onto the luminaire fixture can accommodate either a 1½ inch tenon or a 2 inch tenon, and seal the tenon entrance of the fixture in either case.

The features of the present invention involve the structure and technique of a ballast pod which can be replaced. This structure and its features may be seen by reference to the drawing figures in which the present invention is described without limitation, and wherein FIG. 1 illustrates an integral molded beam luminaire having the removable and replaceable ballast pod of the present invention;

Figure 1:
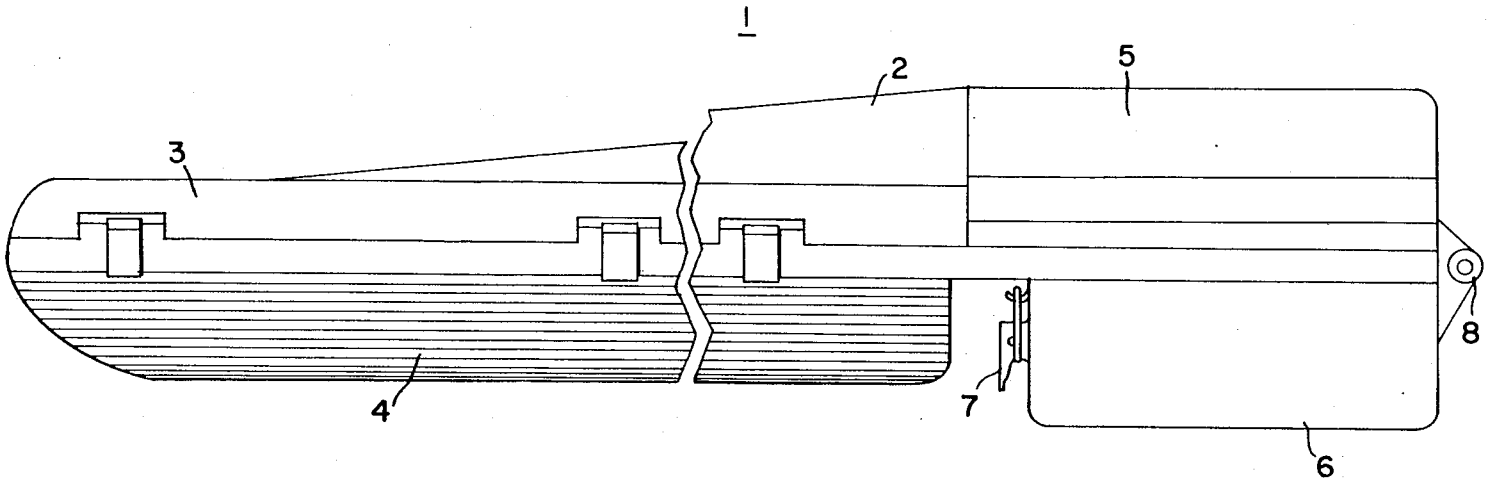

The improved luminaire 1 according to the present invention may be seen in FIG. 1. The luminaire 1 includes a housing structure 3 of a laminated plastic with the inside plastic serving as the light refractor and the outside layer serving as protection from the weather and exposure. This luminaire has a structural beam 2 integrally formed as a part of its construction with the beam extending for a major part of the longitudinal length. This structural beam significantly improves the longitudinal strength of the luminaire. The lamp support 5 may be constructed to enable adjustment of the lamp into three positions to provide three separate photometric patterns in one fixture. The luminaire may be hung from a fixture of a light pole by way of tenons having either of the sizes of 1½ inch or 2 inch diameters which may be sealed into tenon entrances of the lamp support 5.

Figure 2:
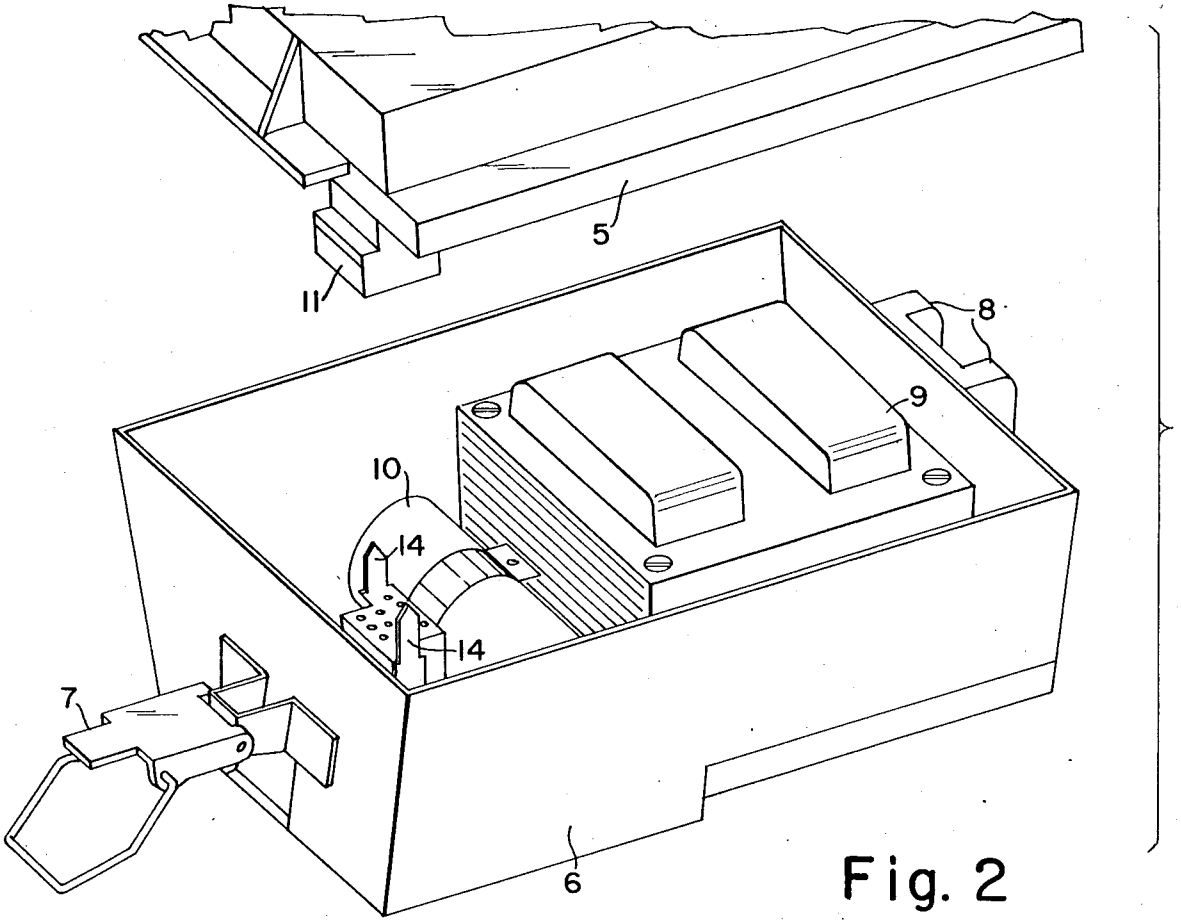
FIG. 2 illustrates in perspective view the structure of the ballast pod according to the present invention.
Figure 3:
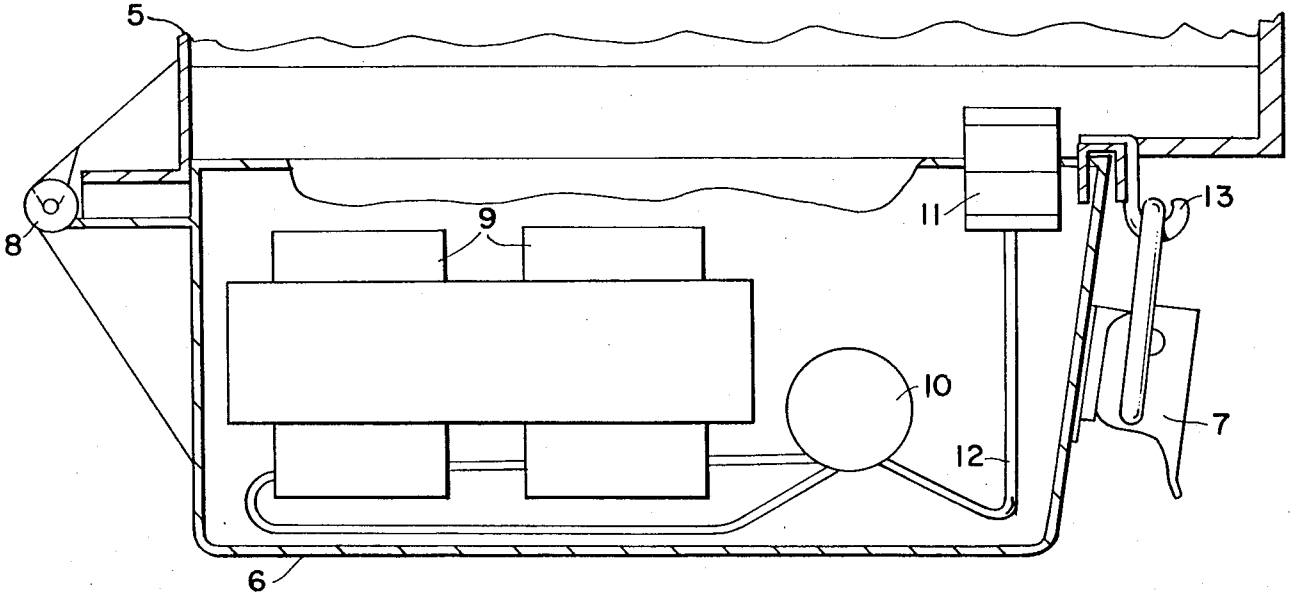
FIG. 3 illustrates a cross sectional view of the ballast pod of the present invention.

From the lamp support 5 a ballast compartment 6 may be hung by way of two simple connectors. First is a latchable connector 7, which as may be seen in FIG. 2 provides a ring-like member which is latched around the hook 13 (seen in FIG. 3), and the releasable hinge 8. Upon pulling the latch member 7 outwardly and downwardly, this hook is released and the ballast pod drops from the light support 5. The releasable hinge 8 may involve a lever that is moved by hand so as to release the hinge members 8 from connection with the light support 5. The releasable latch connector 7 is at the other end of the ballast pod 6 from the hinge 8.

The ballast pod includes in the interior the ballast 9, as seen in FIG. 2, as well as the ballast capacitors 10 and a self-aligning connector 11. This connector includes holes into which pin fittings may be placed in the electrical connection between the ballast pod and the light support 5, and self-aligning poles 14 are provided to ensure electrical connection.

Figure 4A:
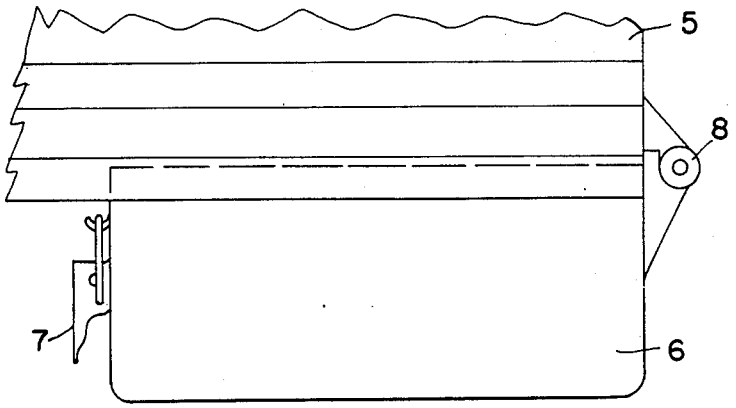
FIGS. 4A–E illustrates the various steps of removal and replacement of the ballast pod of the present invention.
Figure 4B:
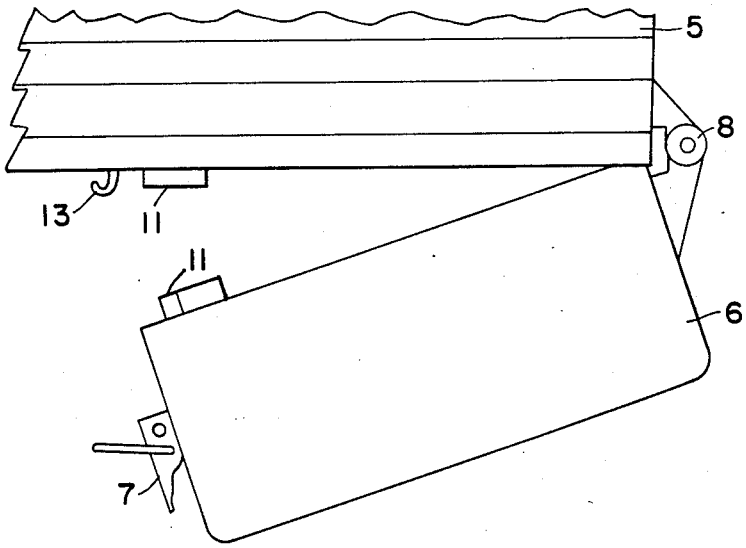
Figure 4C:
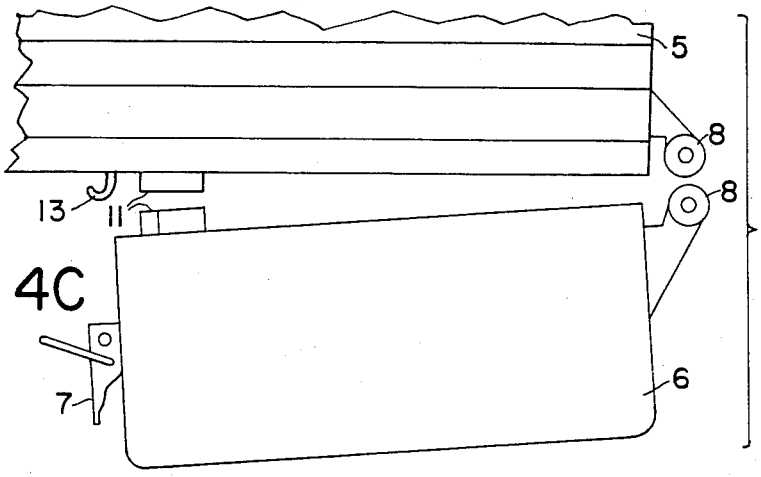

In order to achieve the disconnection and removal of the ballast pod, FIG. 4A shows the closed structure in which as a first step the latch connector 7 is released or unlatched by hand by pulling it outwardly and releasing the ring-like member from hook 13. The ballast pod 6 is then pulled downwardly to rotate about the hinge 8 and disconnect the floating self-locating or aligning connector 11, as seen in FIG. 4B. Thereafter, as shown in FIG. 4C, the release lever 8 is moved by hand and the entire ballast pod 6 is removed.

Figure 4D:
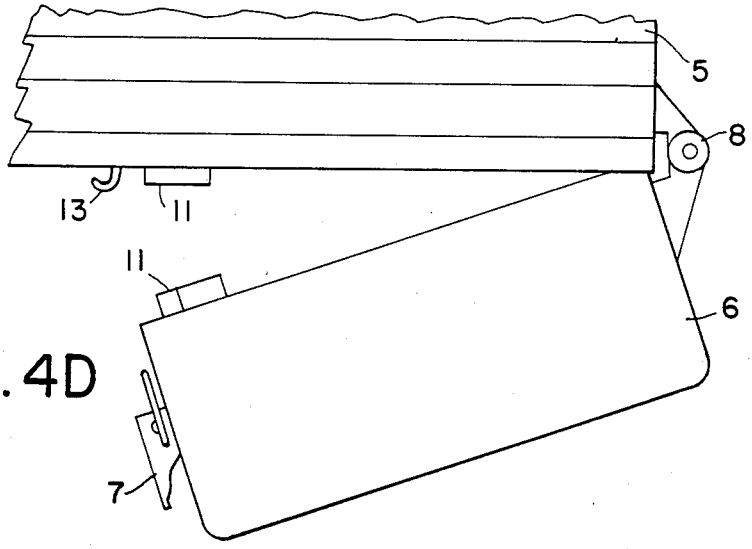
Figure 4E:
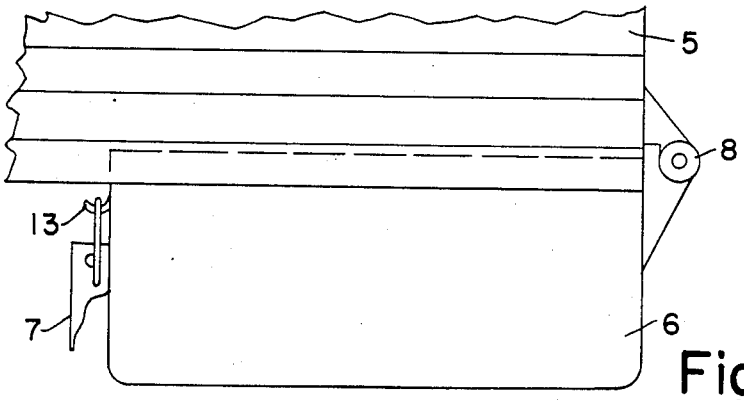

Upon obtaining a suitable or working new ballast pod having the same structure, it is re-inserted into the luminaire, according to FIG. 4D, by moving the releasable lever back into the hinge connection 8 and connecting the latchable connector 7. These can be easily done by hand so that upon closing the pod 6 to the luminaire lamp support 5, the structure is complete and a new ballast pod has been inserted onto the luminaire.

The ease by which this removal and insertion of a new ballast pod into the luminaire can be achieved is significant since it can be replaced in the extremely easy manner without the use of tools. In particular, in cold weather it can be done by hand with gloves.

What I claim:

1. In a low pressure sodium roadway or area luminaire comprising a luminaire housing supported by a lamp support and a ballast housing, said luminaire having an improved ballast structure, the improvement comprising a structural ballast housing pod containing a luminaire ballast, ballast capacitors, and self-aligned connector means including a lever for electrically connecting said structural ballast pod to said lamp support;

releasable hinge means for attaching said structural ballast pod to said lamp support; and latchable connector means for connecting said structural ballast pod to said lamp support, wherein upon release of said latchable connector means and said releasable hinge means, said structural ballast pod is completely removable without tools from said lamp support and said structural ballast pod can be replaced by another structural ballast pod.

2. A roadway or area luminaire according to claim 1, wherein said releasable hinge means is disposed at an opposite side of said structural ballast pod from said latchable connector means.

3. A method of removing without tools a ballast structure from a low pressure sodium roadway or area luminaire, said ballast structure including a ballast housing pod, latchable connector means for connecting said ballast housing pod to a lamp support of said luminaire at one side of said ballast housing pod, and releasable hinge means including a lever for attaching said ballast housing pod to said lamp support at an opposite side of said ballast housing pod, said method comprising unlatching without tools said latchable connector means from said lamp support to release said one said of said ballast housing pod, releasing without tools said releasable hinge means from said lamp support to release said opposite side of said ballast housing pod, and removing completely said ballast housing pod from said lamp support.

4. A method according to claim 3, wherein said step of unlatching said latchable connection means is carried out by pulling by hand a ring-like latch connector outwardly and downwardly from said ballast housing pod.

5. A method according to claim 3 or claim 4, wherein said step of releasing said releasable hinge means is carried out by removing the lever by hand from said releasable hinge means.

* * * * *